US005189249A

United States Patent [19]

Burkhardt et al.

[11] Patent Number: 5,189,249

[45] Date of Patent: Feb. 23, 1993

[54] GEL PROPELLANT AMMUNITION

[75] Inventors: William C. Burkhardt; Michael W. Diehl, both of Hagerstown, Md.; Wesley F. Spence, Wallingford, Pa.

[73] Assignee: E. I. Du Pont de Nemours and Company, Wilmington, Del.

[21] Appl. No.: 790,865

[22] Filed: Nov. 14, 1991

[51] Int. Cl.[5] ..... C06B 45/04; F42B 5/02

[52] U.S. Cl. ..... 102/430; 102/292; 149/2; 149/17

[58] Field of Search ..... 149/2, 17; 102/430, 102/292

[56] References Cited

U.S. PATENT DOCUMENTS

| | | | |
|---|---|---|---|
| 3,067,575 | 12/1962 | Corbutt | 60/243 |
| 3,749,615 | 7/1973 | Dorsey et al. | 102/430 |
| 3,765,967 | 10/1973 | Funk et al. | 149/21 |
| 3,784,421 | 1/1974 | Craig | 149/29 |
| 3,912,560 | 10/1975 | Forrest | 149/93 |
| 4,012,246 | 3/1977 | Forrest | 149/47 |
| 4,128,443 | 12/1978 | Pawlak et al. | 149/71 |
| 4,132,574 | 1/1979 | Forrest | 149/47 |
| 4,198,253 | 4/1980 | Kirchnerova et al. | 149/61 |
| 4,572,078 | 2/1986 | Bell | 102/430 |

*Primary Examiner*—Edward A. Miller
*Attorney, Agent, or Firm*—Charles E. Krukiel

[57] ABSTRACT

An insensitive gel propellant composition based on a fine-particle detonating high explosive which contains from about 10 to 15 wt. % water, and which will not ignite until subjected to a temperature of about 900 psi.

3 Claims, 3 Drawing Sheets

GEL PROPELLANT AMMUNITION

BACKGROUND OF THE INVENTION

The present invention relates to a new "stable" gel propellant composition, and, more particularly, to a gel propellant composition which contains from about 5 up to 25 wt. % water and does not ignite until pressurized to a pressure of about 900 psi, but then burns at a flame temperature which is substantially cooler than the flame temperatures of solid and liquid propellants of equivalent charge, e.g., at a flame temperature that can be as low as 2000° K. and even cooler.

Currently available propellants of the type typically used in a primed shell or cartridge for rifle and handgun ammunition, for example, can be characterized as having a relatively low burn rate which is measured in centimeters per second. Burn, i.e., flame, temperatures typically can be as high as 2300° K., but are usually higher in the range of up to 3700° K. Such high temperatures are a significant factor in reducing gun barrel life. In addition, burning propellants now in use can produce varying degrees of smoke, fumes and residue, and they can be a substantial safety hazard if not handled correctly or if they are subjected to accident because they can ignite at atmospheric pressure from external stimuli, such as, for example, from heat, friction and impact. For these reasons they are also vulnerable to hostile projectiles.

The propellant of the present invention is a semi-plastic gel composition based on a solid fine particle high explosive which is admixed with an oxidizer and lower energy fuels and which contains from about 5 up to 25 wt. % water and which will not ignite until subjected to a pressure, e.g., from a primer, a booster, or externally applied pressure (liquid or gas) in a closed chamber, of at least about 900 psi. The gel propellant composition is cooler burning and safer to handle, use, and transport than currently available propellants.

SUMMARY OF THE INVENTION

The present invention is an extremely stable, i.e., very insensitive, semi-plastic gel propellant composition which will not ignite until subjected to a pressure of at least about 900 psi and, when ignited, will burn with a flame temperature which is generally less than about 2000° K. Improvement in the level of insensitivity is achieved according to the invention by incorporating into the propellant formulation from at least about 5 wt. % and up to about 25 wt. % water. The gel composition of the invention comprises the following essential ingredients:

(a) from about 15 to 30 wt. % of a solid detonating high explosive, such as, for example, fine particle pentaerythrotal tetranitrate (PETN) or trimethylene trinitramine (RDX);

(b) from about 40 to 60 wt. % ammonium nitrate, an oxidizer;

(c) from about 1 to 5 wt. % of a gum thickening agent, such as, for example, guar gum;

(d) from about 5 to 25 wt. % water; and (e) from about 1 to about 5 wt. % nitrocellulose. In addition, the gel propellant composition may also contain other ingredients, i.e., modifiers, such as, for example, up to about 10 wt. % urea; up to about 5 wt. % of a carbon material, such as, for example, uintaite (available under the trademark Gilsonite), ground rubber, carbon black, or any other high carbon content material which does not contain metals; up to about 1 wt. % of an organic base; up to about 5 wt. % starch; and trace amounts of a cross-linking agent, such as potassium pyroantimonate.

The composition is prepared by first forming a homogeneous mixture of the dry components, adding the wet and the liquid ingredients to the dry mixture, and then thoroughly mixing the resulting composition for at least about fifteen minutes to form a semi-plastic gel. The gel composition of the invention is substantially insensitive in that it will not burn, i.e., ignite, until pressurized to a pressure of at least about 900 psi, and after ignition, the composition burns with a flame temperature which is cooler than the flame temperatures of other known propellants, i.e., at a flame temperature which is generally in the range of about 2000° K. or below.

As used herein, the term "insensitive" means that the composition is more difficult to ignite by impact, flame, friction and/or mechanical force than currently available propellants. With reference to the armed services, any propellant composition, including the gel composition of the invention, which attempts to meet any of the insensitivity tests defined in D.O.D. Specification No. 8010.5 is considered "insensitive."

DETAILED DESCRIPTION OF THE INVENTION

Figure 1:
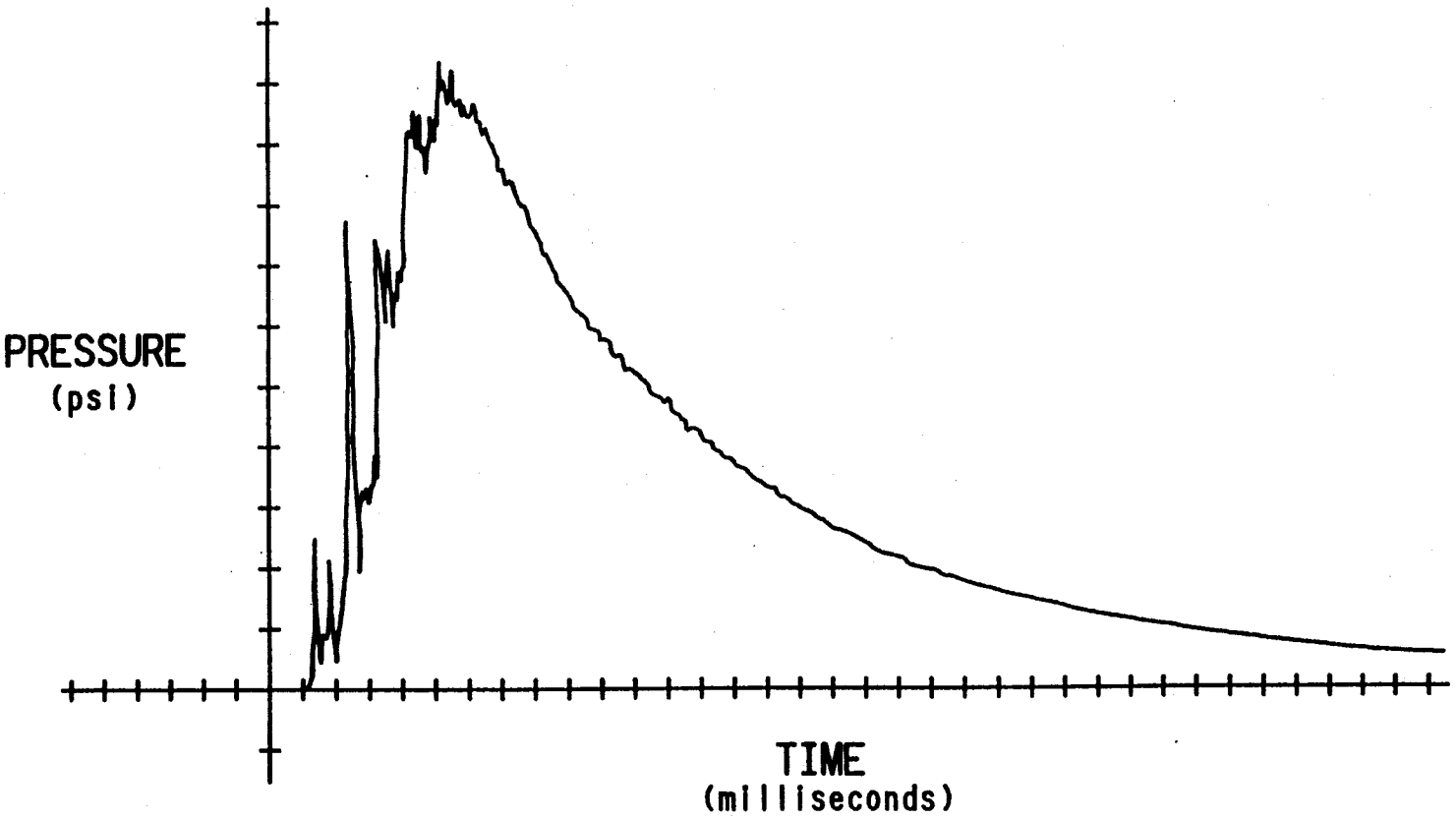
FIG. 1 is a graph of pressure vs. time for a typical gel composition of the invention when fired in a 50 caliber weapon.

The present invention is a semi-plastic gel propellant composition which contains from about 5 up to about 25 wt. % water. The presence of water at concentrations which exceed the levels published for known powder propellants unexpectedly reduces the sensitivity of the gel composition so that the propellant will not ignite, i.e., burn, unless pressurized to a pressure of at least 900 psi. The gel composition is a very viscous fluid having a density of about 1 to 1.6 grams/cc or higher which can be volumetrically loaded into primed shell casings or cartridges to propel projectiles.

The composition of the invention is comprised of ingredients which are known and generally available commercially. For example, in addition to water, the composition will contain from about 15 to 30 wt. % of a solid detonating high explosive preferably selected from the group consisting of fine particle pentaerythrotal tetranitrate (PETN) and trimethylene trinitramine (RDX), although other solid detonating high explosives and mixtures thereof can also be used with satisfactory results. As used herein, the term "fine particle explosive" refers to commercially available explosives which have a particle size generally less than about 30 microns. Fine particle explosives tend to disperse more uniformly within the gel propellant composition of the invention than explosives of larger size.

The composition will also contain from about 40 to about 60 wt. % of an oxidizer, which is preferably ammonium nitrate; from about 1 to 3 wt. % of a gelling, i.e., thickening, agent, which is preferably guar gum; and from about 1 to 5 wt. % nitrocellulose.

Other components which are employed in the gel composition include a stabilizing agent, i.e., an organic base, in an amount up to about 1 wt. %. Diphenylamine is the preferred stabilizing agent for economy and ease of handling. The presence of ammonium nitrate and nitrocellulose may result during long term storage in the generation of nitric acid within the gel composition. The stabilizing agent is present in an amount calculated to neutralize any nitric acid which may form. Up to about 5 wt. % starch and up to about 10 wt. % urea may optionally be included in the composition. Starch serves as a thickening agent, and the presence of urea in the composition operates to restrict the flame/combustion temperature of the mixture. The flame temperature of the mixture can, thus, be varied depending on the amount of urea present in the mixture, but, generally speaking, the flame temperature of the gel propellant is preferably in the range of about 2000° K. The composition will also include a carbon material, such as, for example, carbon black, uintaite (a black lustrous asphalt available under the trademark Gilsonite) or ground rubber, in an amount up to about 5 wt. % for its fuel value and for its ability to control the oxygen balance of the gel propellant.

The propellant composition of the invention can be prepared by first combining the various dry ingredients in their respective proportions and mixing them in a commercial mixer for a time sufficient for the mixture to become homogeneous. Mixing can be accomplished, for example, using a 10-gallon sigma blade mixer at a moderate speed of about 20 rpm for at least about 5 minutes. Mixing equipment is well known among preparers of commercial explosives, and mixing speed will depend primarily on mixer size. For best results, dry ingredients are finely ground to a size of 20 mesh or finer. The carbon material, however, especially ground rubber, can be used as commercially obtained without further grinding.

The wet ingredients, i.e., fine particle PETN or RDX, nitrocellulose and water, in their respective proportions are next dispersed uniformly on top of the homogeneous mixture of dry ingredients already in the mixer, after which mixing is continued at the same speed as used for mixing the dry ingredients for at least about ten minutes, which insures that the guar gum and other thickening agent(s), if any, are completely dispersed within the newly formed gel composition. Ordinarily, for safety reasons, this procedure is accomplished by remote control. Optionally, mixing the wet ingredients can be accomplished at an elevated temperature in the range of from about 30° to about 36° C. which aids complete dispersion, i.e., shortens mixing time.

It will be appreciated by those skilled in the art of explosives preparation that the ratios of the various ingredients comprising the gel composition of the invention can be varied according to the desired or required burning characteristics for the particular propellant application. It may also be advantageous when the propellant is to be used in a shell casing to crosslink it with a commercially available cross-linking agent, such as, for example, potassium pyroantimoneate buffered with an acid, such as citric acid, which results in the formation of a more solid-acting material after loading.

In a preferred embodiment, the gel propellant composition of the invention comprises the following ingredients in the proportions (wt. %) shown in Table 1.

TABLE 1

| Ingredient | Example 1 | Example 2 |
|---|---|---|
| PETN | 20.1 | 19.8 |
| N/C | 0 | 5.0 |
| AN | 53.8 | 49.4 |
| Urea | 0 | 5.9 |
| DPA | 0 | 1.0 |
| Carbon Mat'l. | 12.1 | 4.0 |
| Guar Gum | 1.0 | 3.0 |
| Water | 10.0 | 12.8 |
| Starch | 3.0 | 0 |

Referring now to the figures, FIG. 1 is a graph of pressure versus time in milliseconds for the gel composition of the invention made according to Example 2 and used in a 50 caliber charge. Ignition and burning, which is denoted by a substantial and continuous upswing in the pressure curve, does not occur until the pressure being imposed on the composition has reached a value of about 900 psi.

Figure 2:
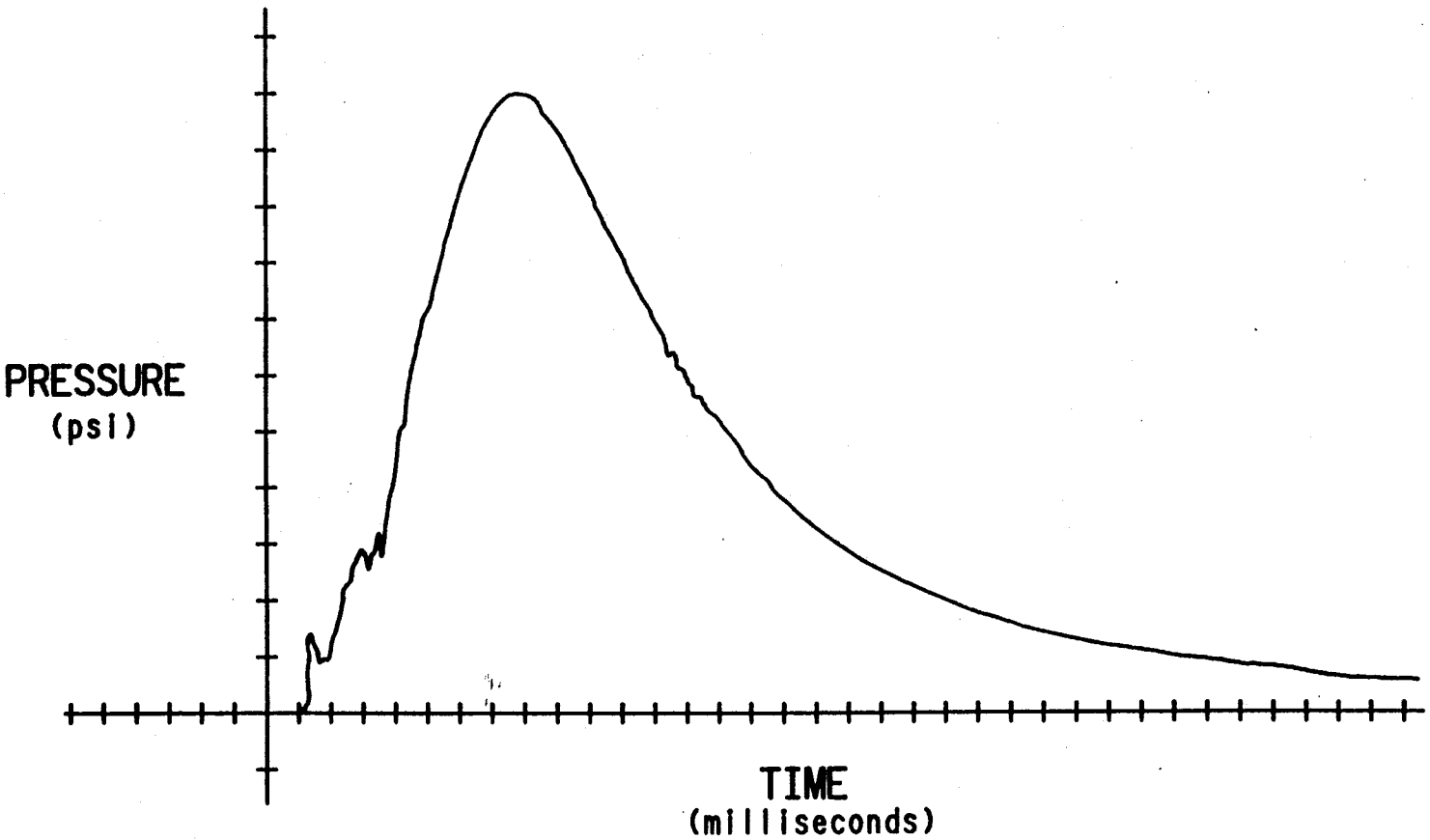
FIG. 2 is a graph of pressure vs. time for a prior art dry grained propellant for a 50 caliber weapon.

FIG. 2 is a graph of pressure versus time in milliseconds for a current dry grained propellant for a 50 caliber weapon which has a moisture specification of 1.00 wt. % plus/minus 0.10 wt. %, i.e., substantially below the water concentration of the gel propellant of the invention. FIGS. 1 and 2 show that the pressure/time profile of the gel propellant is substantially the same as the pressure/time profile of the current dry grained propellant.

Figure 3:
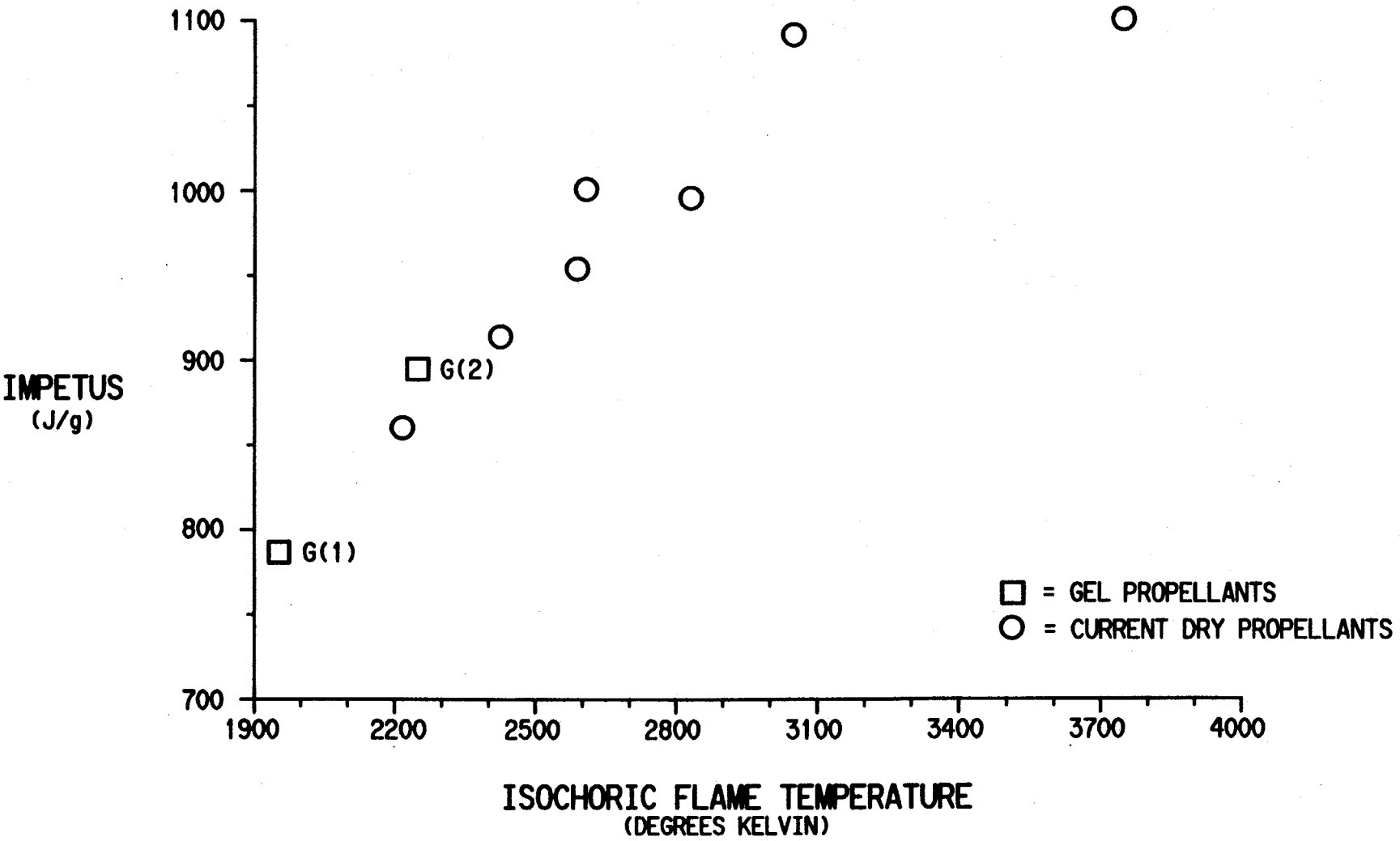
FIG. 3 is a graph of impetus vs. flame temperature for known and gel propellants.

FIG. 3 is a graph which compares impetus versus flame temperature for the gel composition prepared according to Example 1 and for various dry grained propellant compositions prepared according to the prior art. It can be seen that flame temperature for the two gel compositions, shown as G(1) and G(2), are between about 1950° and 2250° K., i.e., substantially cooler than the flame temperatures of almost all of the prior art dry grained propellants, the highest of which is about 2700° K.

The gel propellant composition of the invention, as stated above, is a generally viscous fluid in contrast to more traditional dry propellants of the type currently used in primed shells to propel projectiles. The propellant can be loaded volumetrically into primed shells, i.e., cartridge casings, covering a wide range of sizes from 5.56 mm up to 35 mm. In larger sizes where a primed shell is not practical, such as, for example, the 105 mm and 155 mm howitzers, the propellant can be packaged separately. So long as a primer capable of producing a pressure on detonation of at least about 900 psi is employed, the gel propellant can produce satisfactory results.

The gel propellant of the invention can be loaded into brass shells of the type currently being used today through their restricted neck, and the bullet then is pressed into the neck and crimped. Ordinarily, the shell is pre-primed, although a booster can be added if needed. The gel propellant of the invention, however, is particularly suited for the next generation of ammunition currently under development which will very likely employ a plastic or composite shell. With a composite shell the bullet can be crimped into the neck first, and the propellant can then be loaded into the body of the shell from the base by an appropriate metering device. Next, a primed base is attached to the shell. The gel propellant for use with next generation composite/-plastic shells of the type referred to herein will also normally contain a crosslinker with activation timed for two or more hours as desired. After crosslinking, the propellant will simulate a soft rubber in substance.

From the foregoing description, one skilled in the art can easily ascertain the essential characteristics of the invention and, without departing from the spirit and scope thereof, can make various changes and modifications to the invention to adapt it to various usages and conditions.

We claim:

1. An improved ammunition comprising a shell, a projectile and an insensitive gel propellant in which the gel propellant comprises:

(a) 20.1 wt % fine particle pentaerythritol tetranitrate;
(b) 1 wt. % guar gum;
(c) 3 wt. % starch
(d) 12.1 wt. % of a carbon material having the formula $C_{10}H_8$;
(e) 53.8 wt. % ammonium nitrate; and
(f) 10 wt. % water.

2. An improved ammunition comprising a shell, a projectile, and a gel propellant in which the gel propellant is not ignitable at pressures below about 900 psi and comprises:

(a) from about 15 to 30 wt. % of a fine particle solid detonating high explosive;
(b) from about 40 to 60 wt. % of an oxidizing agent;
(c) from about 1 to 5 wt. % gum thickening agent;
(d) from about 5 wt. % to about 25 wt. % water;
(e) from about 1 to 5 wt. % nitrocellulose; and optionally
(f) up to about 0.1 wt. % cross-linker.

3. The ammunition of claim 2, in which, in the propellant, the solid detonating high explosive is selected from the group consisting of fine particle pentaerythrotal tetranitrate and trimethylene trinitramine, and the propellant contains a carbon material and a base wherein the carbon material is carbon black or uintaite having a chemical formula of $C_{10}H_8$, and the base is diphenylamine.

* * * * *